US009962939B2

(12) United States Patent
Yoshiike

(10) Patent No.: US 9,962,939 B2
(45) Date of Patent: May 8, 2018

(54) LIQUID DISCHARGE HEAD, LIQUID DISCHARGE DEVICE, AND LIQUID DISCHARGE APPARATUS

(71) Applicant: Masataka Yoshiike, Kanagawa (JP)

(72) Inventor: Masataka Yoshiike, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/268,718

(22) Filed: Sep. 19, 2016

(65) Prior Publication Data

US 2017/0100935 A1 Apr. 13, 2017

(30) Foreign Application Priority Data

Oct. 8, 2015 (JP) ..... 2015-200600

(51) Int. Cl.
*B41J 2/16* (2006.01)
*B41J 2/14* (2006.01)

(52) U.S. Cl.
CPC ..... *B41J 2/1623* (2013.01); *B41J 2/14233* (2013.01); *B41J 2/161* (2013.01); *B41J 2002/14241* (2013.01); *B41J 2002/14362* (2013.01); *B41J 2002/14491* (2013.01)

(58) Field of Classification Search
CPC ..... B41J 2002/14241
See application file for complete search history.

(56) References Cited

U.S. PATENT DOCUMENTS 4,935,750 A * 6/1990 Hawkins ..... B41J 2/1623 216/27
6,382,780 B1 * 5/2002 Watanabe ..... B41J 2/14274 347/68
2005/0116995 A1 * 6/2005 Tanikawa ..... B41J 2/1623 347/56

(Continued)

FOREIGN PATENT DOCUMENTS

JP 05345417 A * 12/1993
JP 2006-027035 2/2006

(Continued)

*Primary Examiner* — Shelby Fidler
(74) *Attorney, Agent, or Firm* — Cooper & Dunham LLP

(57) ABSTRACT

A liquid discharge head includes an actuator substrate, a holding substrate, a common-liquid-chamber substrate, and a vibration absorber. The actuator substrate includes a plurality of individual liquid chambers and a plurality of pressure generating elements. The individual liquid chambers are communicated with a plurality of nozzles to discharge liquid. The pressure generating elements are arrayed to pressurize liquid in the individual liquid chambers. The holding substrate includes a recessed portion to accommodate the pressure generating elements. The common-liquid-chamber substrate includes a common liquid chamber to supply the liquid to the individual liquid chambers. The common-liquid-chamber substrate is bonded to the holding substrate. The vibration absorber is disposed at at least a part of a bonded portion of the common-liquid-chamber substrate and the holding substrate, to absorb vibration. The holding substrate has an opening as a channel communicating the individual liquid chambers with the common liquid chamber.

16 Claims, 15 Drawing Sheets

(56) References Cited

U.S. PATENT DOCUMENTS

| | | | | |
|---|---|---|---|---|
| 2006/0012647 | A1 | 1/2006 | Yamada et al. | |
| 2008/0180492 | A1* | 7/2008 | Ito | B41J 2/14209 347/71 |
| 2011/0122199 | A1* | 5/2011 | Takemoto | B41J 2/055 347/48 |
| 2012/0236082 | A1* | 9/2012 | Akahane | B41J 2/14274 347/68 |
| 2013/0194352 | A1* | 8/2013 | Watanabe | B41J 2/14233 347/71 |
| 2016/0096386 | A1 | 4/2016 | Yoshiike | |

FOREIGN PATENT DOCUMENTS

| | | |
|---|---|---|
| JP | 2007-181991 | 7/2007 |
| JP | 2015-009461 | 1/2015 |

* cited by examiner

LIQUID DISCHARGE HEAD, LIQUID DISCHARGE DEVICE, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2015-200600 filed on Oct. 8, 2015 in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus.

Related Art

A liquid discharge head may include, for example, a holding substrate (also referred to as protective substrate) bonded on an actuator substrate. The holding substrate covers a plurality of pressure generating elements arrayed on the actuator substrate. The holding substrate is bonded to a common-liquid-chamber substrate with adhesive. The common-liquid-chamber substrate includes a common liquid chamber to supply liquid to individual liquid chambers.

SUMMARY

In an aspect of the present disclosure, there is provided a liquid discharge head that includes an actuator substrate, a holding substrate, a common-liquid-chamber substrate, and a vibration absorber. The actuator substrate includes a plurality of individual liquid chambers and a plurality of pressure generating elements. The plurality of individual liquid chambers is communicated with a plurality of nozzles to discharge liquid. The plurality of pressure generating elements is arrayed to pressurize liquid in the plurality of individual liquid chambers. The holding substrate includes a recessed portion to accommodate the plurality of pressure generating elements. The common-liquid-chamber substrate includes a common liquid chamber to supply the liquid to the plurality of individual liquid chambers. The common-liquid-chamber substrate is bonded to the holding substrate. The vibration absorber is disposed at at least a part of a bonded portion of the common-liquid-chamber substrate and the holding substrate, to absorb vibration. The holding substrate has an opening as a channel communicating the plurality of individual liquid chambers with the common liquid chamber.

In another aspect of the present disclosure, there is provided a liquid discharge device that includes the liquid discharge head.

In still another aspect of the present disclosure, there is provided a liquid discharge apparatus that includes the liquid discharge device.

In still yet another aspect of the present disclosure, there is provided a liquid discharge apparatus that includes the liquid discharge head.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
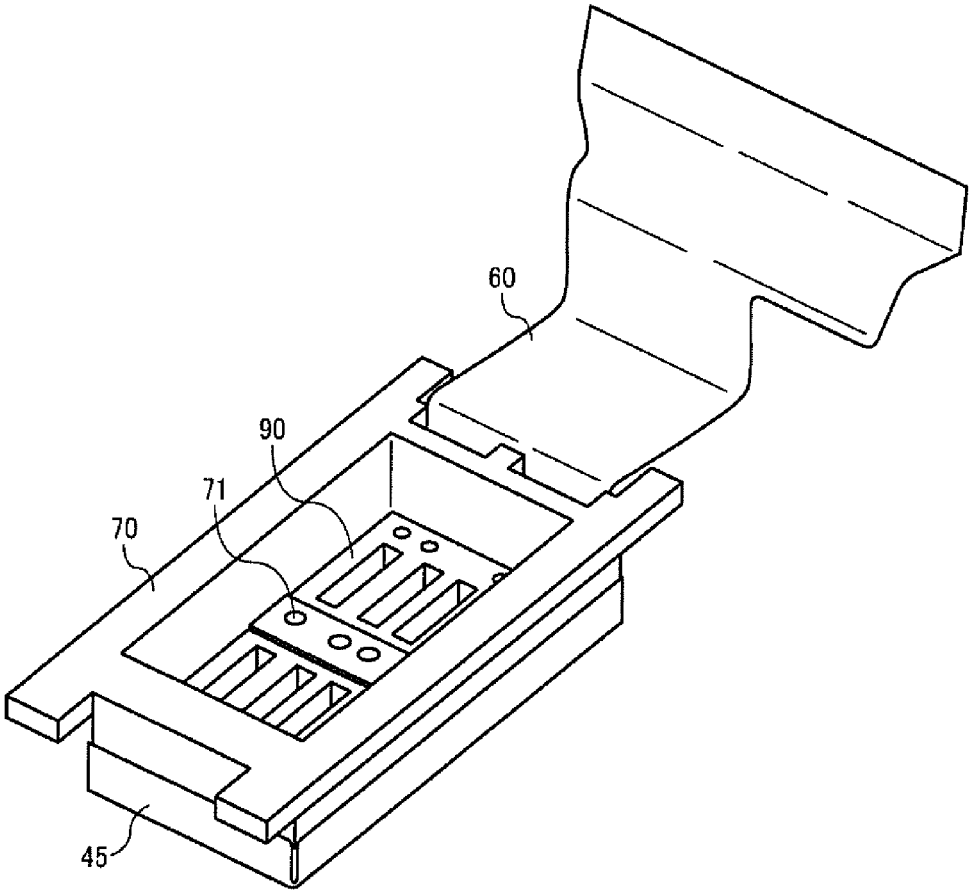
FIG. 1 is a perspective view of an example of a liquid discharge head according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, wherein like reference numerals designate identical or corresponding parts throughout the several views, embodiments of the present disclosure are described below.

Figure 2:
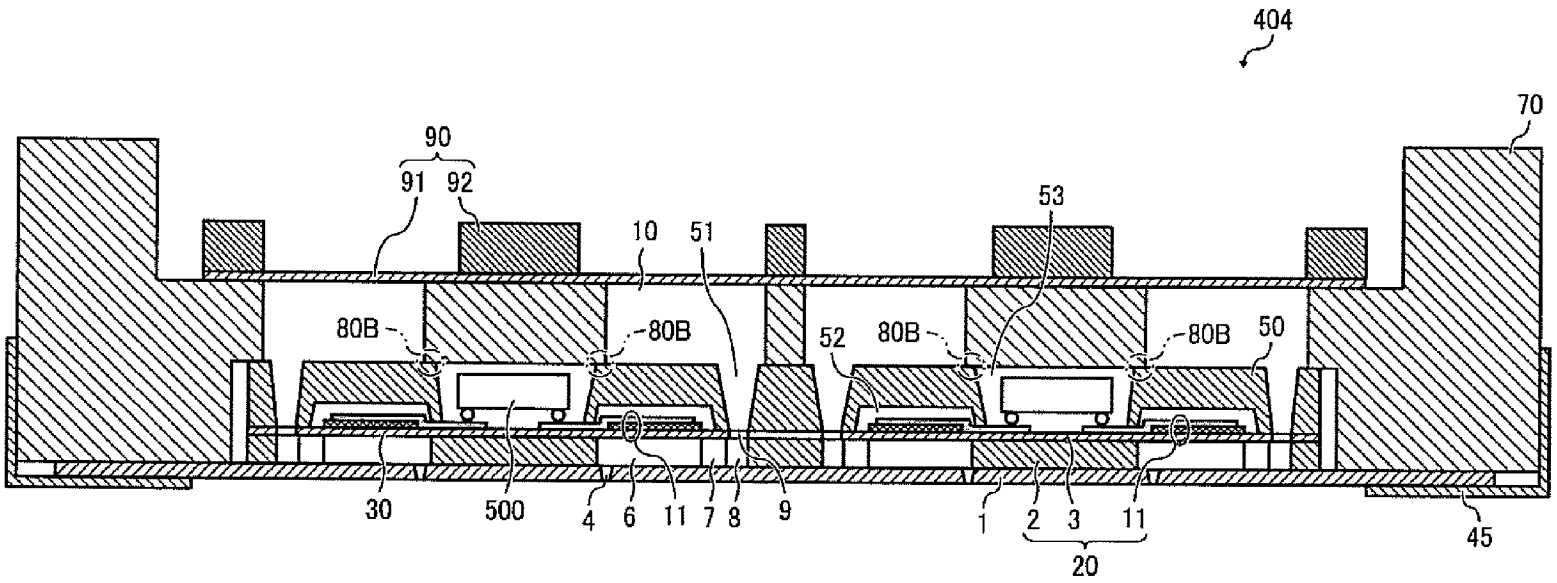
FIG. 2 is a cross-sectional view of a portion of the liquid discharge head of FIG. 1 cut along a direction perpendicular to a nozzle array direction in which nozzles are arrayed in row.
Figure 3:
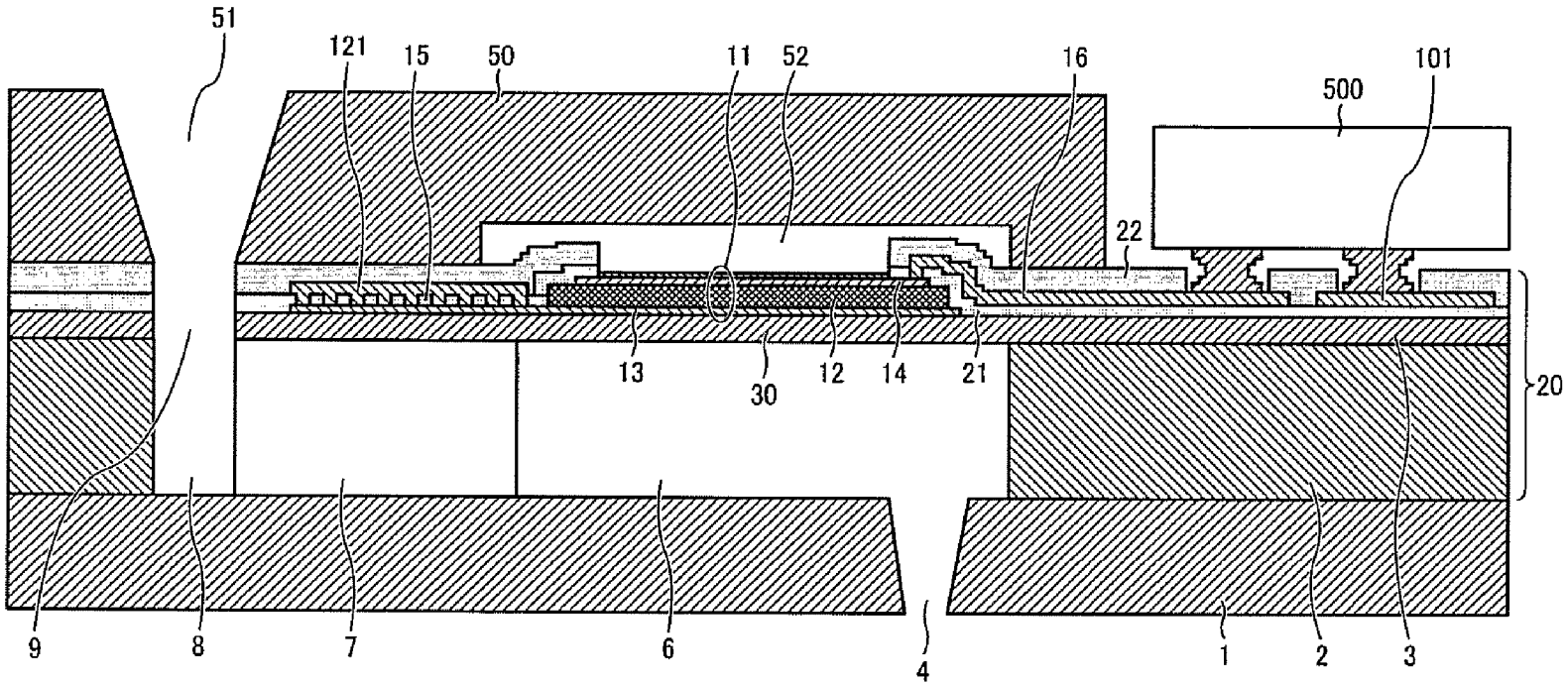
FIG. 3 is an enlarged cross-sectional view of a portion of the liquid discharge head of FIG. 2.
Figure 4:
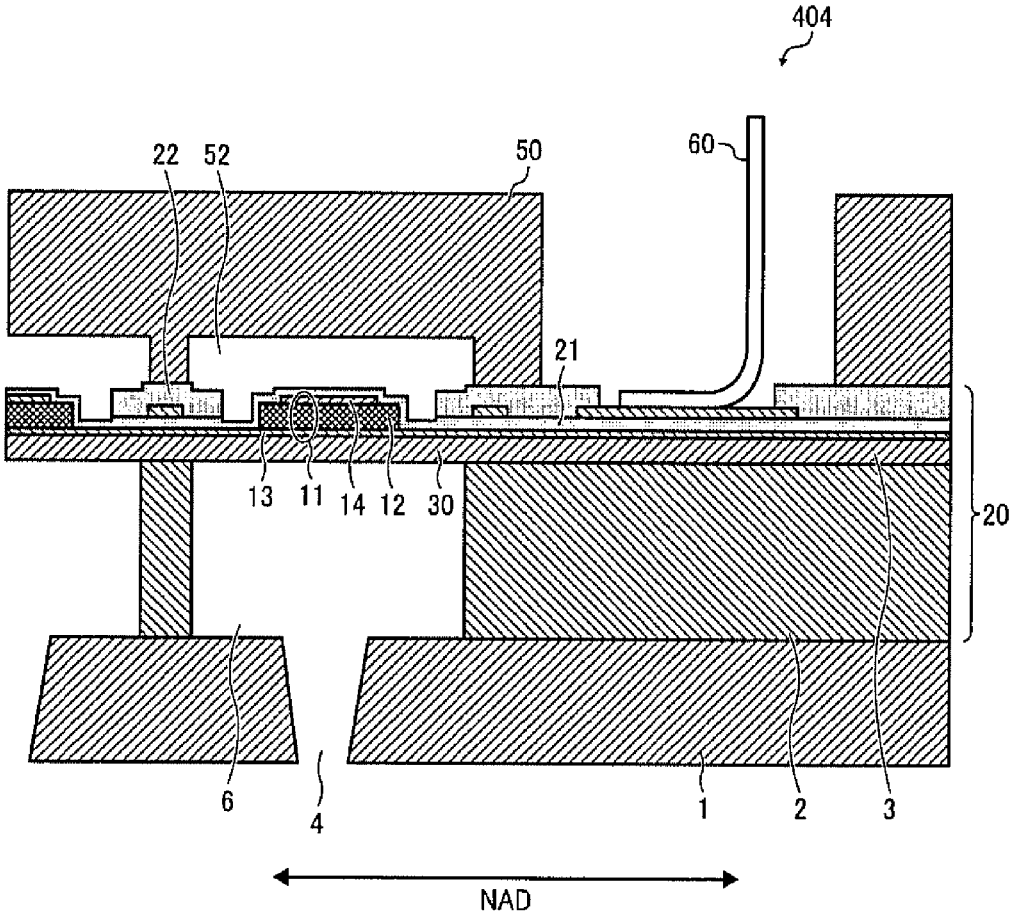
FIG. 4 is a cross-sectional view of a portion of the liquid discharge head of FIG. 2 cut along the nozzle array direction.

A liquid discharge head according to an embodiment of the present disclosure is described with reference to FIGS. 1 to 4. FIG. 1 is an exploded perspective view of the liquid discharge head according to an embodiment of the present disclosure. FIG. 2 is a cross-sectional view of the liquid discharge head of FIG. 1 cut along a direction perpendicular to a nozzle array direction in which nozzles are arrayed in row. FIG. 3 is an enlarged cross-sectional view of a portion of the liquid discharge head of FIG. 2. FIG. 4 is a cross-sectional view of a portion of the liquid discharge head of FIG. 2 cut along the nozzle array direction.

A liquid discharge head 404 according to the present embodiment includes a nozzle plate 1, a channel plate 2, a diaphragm plate 3 as a wall member, a piezoelectric element 11 as a pressure generating element (pressure generator), a holding substrate 50, a wiring member 60, and a frame substrate 70 also serving as a common-liquid-chamber substrate.

The channel plate 2, the diaphragm plate 3, and the piezoelectric element 11 form an actuator substrate 20 according to the present embodiment. Note that the actuator substrate 20 does not include the nozzle plate 1 or the holding substrate 50 that is bonded to the actuator substrate 20 after the actuator substrate 20 is formed as an independent component. The channel plate 2 and the diaphragm plate 3 form a channel substrate.

The nozzle plate 1 includes a plurality of nozzles 4 to discharge liquid. In the present embodiment, the nozzles 4 are arrayed in four rows.

With the nozzle plate 1 and the diaphragm plate 3, the channel plate 2 forms individual liquid chambers 6 communicated with the nozzles 4, fluid restrictors 7 communicated with the individual liquid chambers 6, and liquid inlets (passages) 8 communicated with the fluid restrictors 7.

The liquid inlets 8 are communicated with the common liquid chambers 10 in the frame substrate 70 via passages (supply ports) 9 of the diaphragm plate 3 and openings 51 as channels of the holding substrate 50.

The diaphragm plate 3 includes deformable vibration portions 30 forming part of walls of the individual liquid chambers 6. The piezoelectric element 11 is disposed integrally with the vibration portion 30 on a face of the vibration portion 30 opposite the individual liquid chamber 6. The vibration portion 30 and the piezoelectric element 11 form a piezoelectric actuator.

In the piezoelectric element 11, a lower electrode 13, a piezoelectric layer (piezoelectric body) 12, and an upper electrode 14 are laminated in this order from the vibration portion 30. An insulation film 21 is disposed on the piezoelectric element 11.

The lower electrode 13 as a common electrode for the plurality of piezoelectric elements 11 is connected to a common-electrode power-supply wiring pattern 121 via a common wire 15. Note that, as illustrated in FIG. 4, the lower electrode 13 is a single electrode layer straddling all of the piezoelectric elements 11 in the nozzle array direction indicated by arrow NAD.

The upper electrodes 14 as discrete electrodes for the piezoelectric elements 11 are connected to a drive integrated circuit (IC) 500 (hereinafter, driver IC 500) as a drive circuit via individual wires 16. The individual wire 16 is covered with an insulation film 22.

The driver IC 500 is mounted on the actuator substrate 20 by, e,g., a flip-chip bonding method, to cover an area between rows of the piezoelectric elements 11.

The driver IC 500 mounted on the actuator substrate 20 is connected to a discrete-electrode power-supply wiring pattern 101 to which a drive waveform (drive signal) is supplied.

One end of the wiring member 60 is electrically connected to the driver IC 500. The opposite end of the wiring member 60 is connected to a controller mounted to an apparatus body.

The openings 51 as channels communicating the common liquid chambers 10 with the individual liquid chambers 6 as described above, recessed portions 52 to accommodate the piezoelectric elements 11, and the holding substrate 50 including openings 53 to accommodate the driver ICs 500 are disposed on the actuator substrates 20.

The holding substrate 50 is bonded to a side of the actuator substrate 20 facing the diaphragm plate 3 with adhesive.

The frame substrate 70 includes the common liquid chambers 10 to supply liquid to the individual liquid chambers 6. Note that, in the present embodiment, the four common liquid chambers 10 are disposed corresponding to the four nozzle rows. Desired colors of liquids are supplied to the respective common liquid chambers 10 via liquid supply ports 71 (see FIG. 1).

A damper unit 90 is bonded to the frame substrate 70. The damper unit 90 includes a damper 91 and damper plates 92. The damper 91 is deformable and forms part of walls of the common liquid chambers 10. The damper plates 92 reinforce the damper 91.

The frame substrate 70 is bonded to the holding substrate 50 and an outer peripheral portion of the nozzle plate 1 with adhesive, to accommodate the actuator substrate 20 and the holding substrate 50, thus forming a frame of the liquid discharge heads 404.

Nozzle covers 45 are disposed to cover part of a peripheral area of the nozzle plate 1 and part of outer circumferential faces of the frame substrate 70.

In the liquid discharge head 404, voltage is applied from the driver IC 500 to a portion between the upper electrode 14 and the lower electrode 13 of the piezoelectric element 11. Accordingly, the piezoelectric layer 12 expands in an electrode lamination direction (in other words, an electric-field direction) in which the upper electrode 14 and the lower electrode 13 are laminated, and contracts in a direction parallel to the vibration portion 30.

At this time, since a side (hereinafter, lower electrode 13 side) of the piezoelectric layer 12 facing the vibration portion 30 is bound by the vibration portion 30, a tensile stress arises at the lower electrode 13 side of the vibration portion 30, thus causing the vibration portion 30 to bend toward a side (hereinafter, individual liquid chamber 6 side) of the vibration portion 30 facing the individual liquid chamber 6. Accordingly, liquid within the individual liquid chamber 6 is pressurized and discharged from the nozzle 4.

Figure 5:
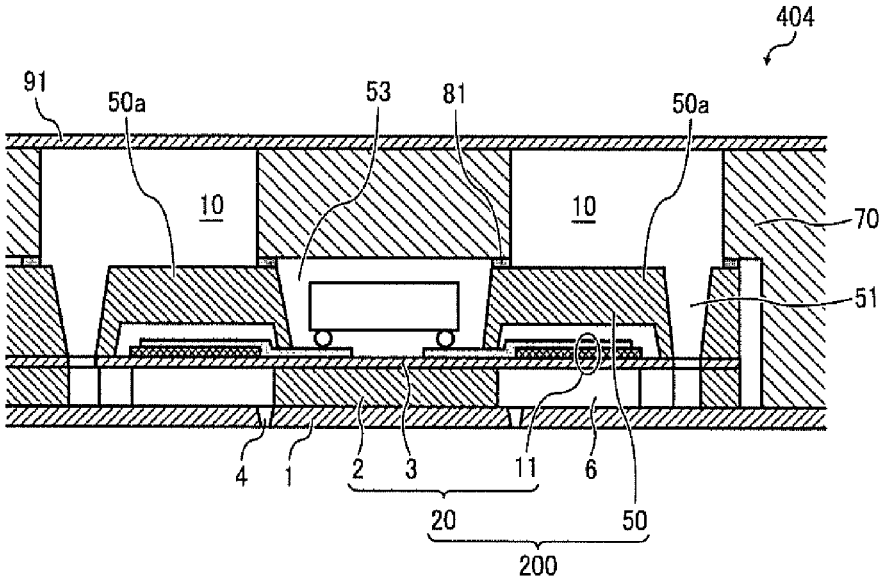
FIG. 5 is an enlarged cross-sectional view of a portion of the liquid discharge head according to a first embodiment of the present disclosure, cut along the direction perpendicular to the nozzle array direction.
Figure 6:
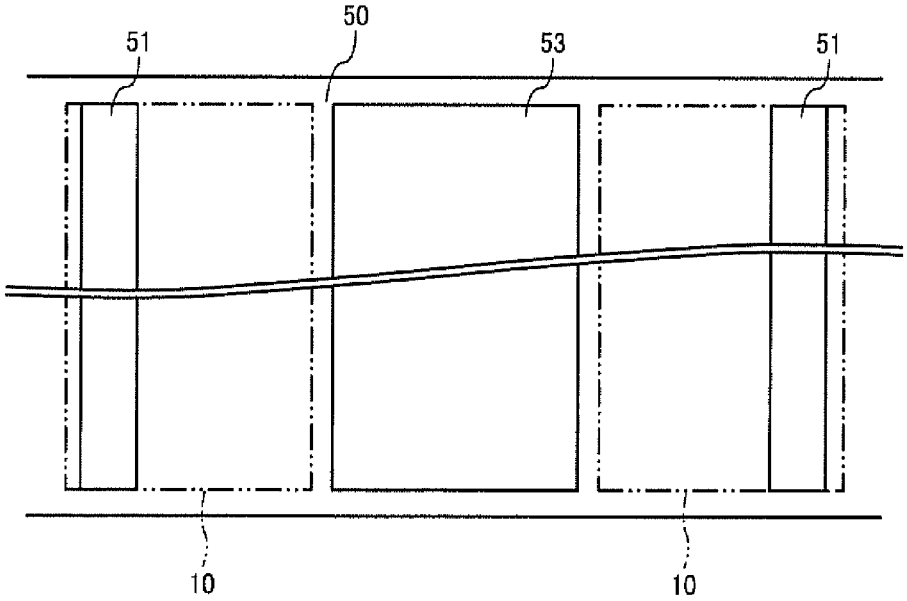
FIG. 6 is a plan view of a portion of a holding substrate in the first embodiment.
Figure 7:
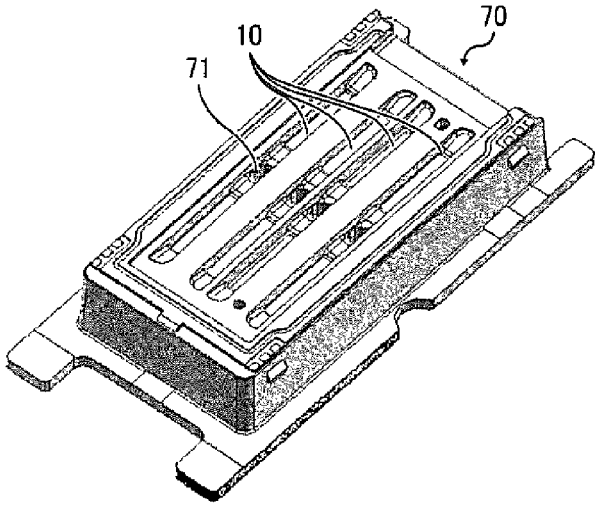
FIG. 7 is a perspective view of a frame substrate in the first embodiment.
Figure 8:
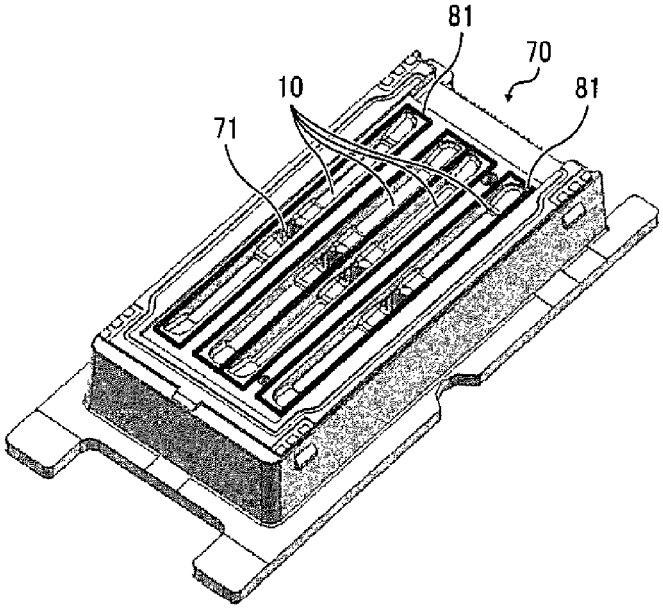
FIG. 8 is a perspective view of the frame substrate of FIG. 7 applied with adhesive.

Next, a first embodiment of the present disclosure is described with reference to FIGS. 5 to 8. FIG. 5 is an enlarged cross-sectional view of a portion of the liquid discharge head according to the first embodiment, cut along the direction perpendicular to the nozzle array direction NAD. FIG. 6 is a plan view of a portion of the holding substrate in the first embodiment. FIG. 7 is a perspective view of the frame substrate in the first embodiment. FIG. 8 is a perspective view of the frame substrate of FIG. 7 applied with adhesive.

The holding substrate 50 bonded to the actuator substrate 20 has the openings 51 as the channels communicating the common liquid chambers 10 with the individual liquid chambers 6. The opening 51 has a length corresponding to the plurality of individual liquid chambers 6 in the nozzle array direction NAD and a substantially rectangular shape in the plan view.

A first face of the holding substrate 50 opposite a second face of the holding substrate 50 bonded to the actuator substrate 20, in other words, a bonded face 50*a* of the holding substrate 50 bonded to the frame substrate 70 as the common-liquid-chamber substrate forms part of walls of the common liquid chambers 10.

The holding substrate 50 is bonded to the frame substrate 70 as the common-liquid-chamber substrate with an elastic adhesive 81 that also acts as a vibration absorber. In other words, a vibration absorber (the elastic adhesive 81) is interposed at bonded portions of the holding substrate 50 and the frame substrate 70 also acting as the common-liquid-chamber substrate.

The elastic adhesive is an adhesive that turns to be a rubber elastic body after curing. For example, a silicone-based adhesive may be used as the elastic adhesive. In the present embodiment, for example, a silicone-based adhesive having a modulus of elasticity of 34 MPa can absorb vibration. Alternatively, an elastic adhesive having a modulus of elasticity of 10 MPa or lower can more effectively absorb vibration.

In the present embodiment, the elastic adhesive is used as the vibration absorber. Note that, in some embodiments, a cured elastomer having flowability may be used.

In the present embodiment, as illustrated in FIG. 8, the elastic adhesive 81 is applied on the frame substrate 70. The elastic adhesive 81 is applied to the bonded face of the frame substrate 70 to surround the common liquid chambers 10 without interruption. The thickness of coating of the elastic adhesive 81 is about several μm. Note that the elastic adhesive 81 may be applied to the holding substrate 50.

In the bonding step, when the holding substrate 50 is bonded to the frame substrate 70 with the elastic adhesive 81, the actuator substrate 20 is bonded to the holding substrate 50 with adhesive to form a structural body 200 (see FIG. 5). Then, the structural body 200 is bonded to the frame substrate 70.

Next, a description is given of operation of the present embodiment.

When the piezoelectric element 11 is driven to vibrate the vibration portion 30 to discharge liquid, the actuator substrate 20 vibrates and the vibration of the actuator substrate 20 is transmitted to the holding substrate 50 bonded to the actuator substrate 20.

When the vibration of the holding substrate 50 is transmitted to the frame substrate 70 also serving as the common-liquid-chamber substrate to vibrate the frame substrate 70, the vibration is transmitted to liquid in the common liquid chambers 10, thus causing pressure fluctuations. Since the common liquid chambers 10 are communicated with the individual liquid chambers 6, pressure fluctuations in the common liquid chambers 10 are transmitted to the individual liquid chambers 6, thus affecting discharge properties. For example, a proper relationship between the pressurization timing of the piezoelectric element 11 and the meniscus position might be disturbed. In such a case, liquid may not be discharged at a target volume and speed, or meniscus may be broken, thus causing liquid leakage.

Hence, for the present embodiment, the holding substrate 50 is bonded to the frame substrate 70 as the common-liquid-chamber substrate with the elastic adhesive 81 also serving as the vibration absorber, to absorb the vibration transmitted from the holding substrate 50 to the frame substrate 70.

Such a configuration can prevent or reduce transmission of the vibration, which has occurred in the holding substrate 50 in driving the liquid discharge head 404, to the frame substrate 70, thus allowing stable discharge.

Figure 9:
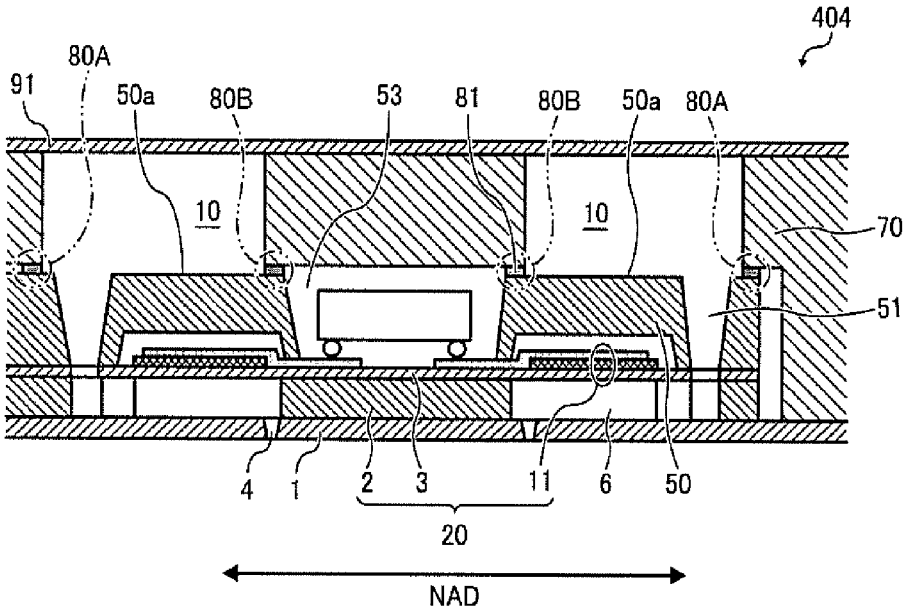
FIG. 9 is an enlarged cross-sectional view of the liquid discharge head according to a second embodiment of the present disclosure, cut along the direction perpendicular to the nozzle array direction.
Figure 10:
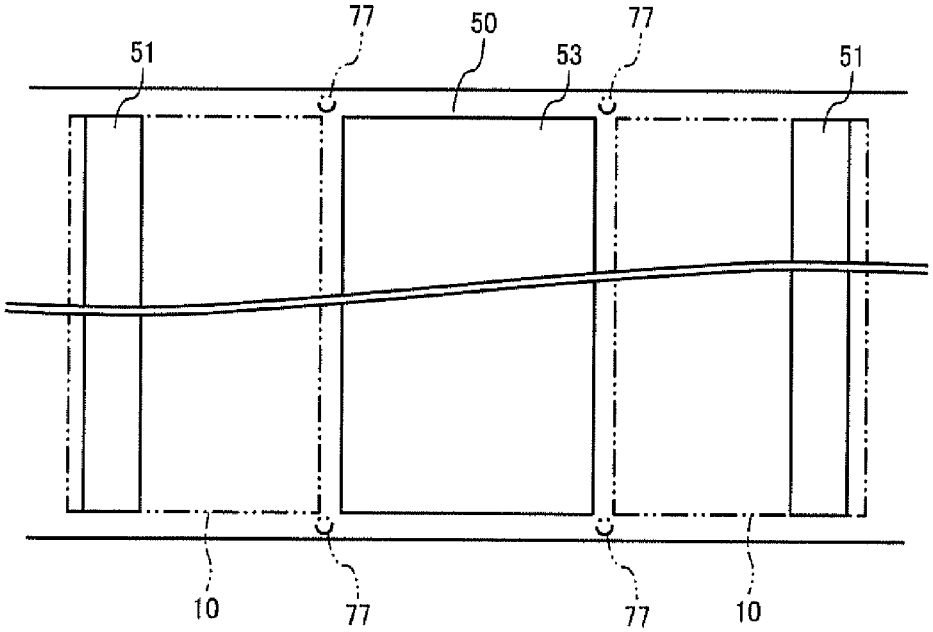
FIG. 10 is a plan view of a portion of the holding substrate in the second embodiment.
Figure 11:
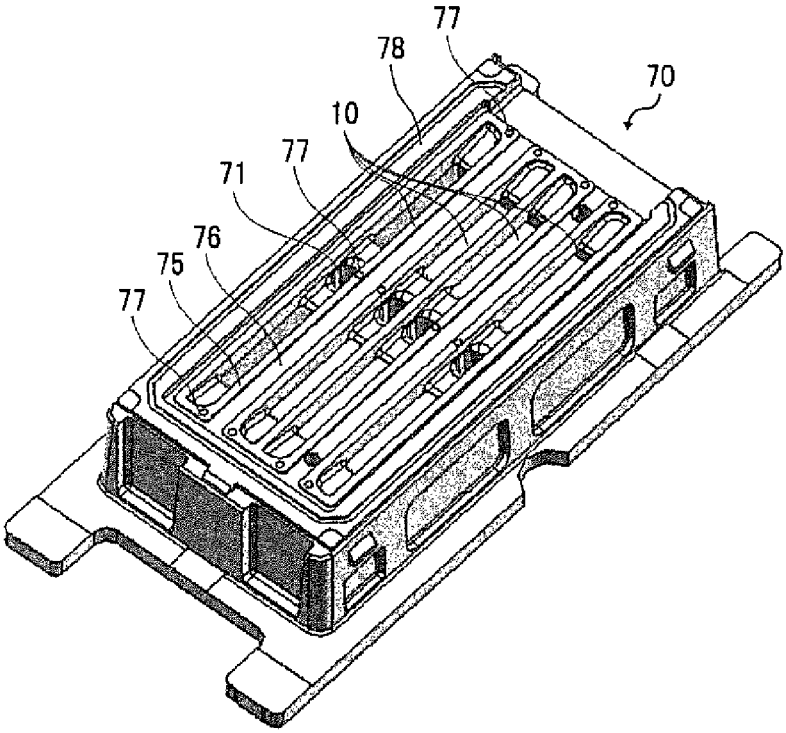
FIG. 11 is a perspective view of the frame substrate in the second embodiment.
Figure 12:
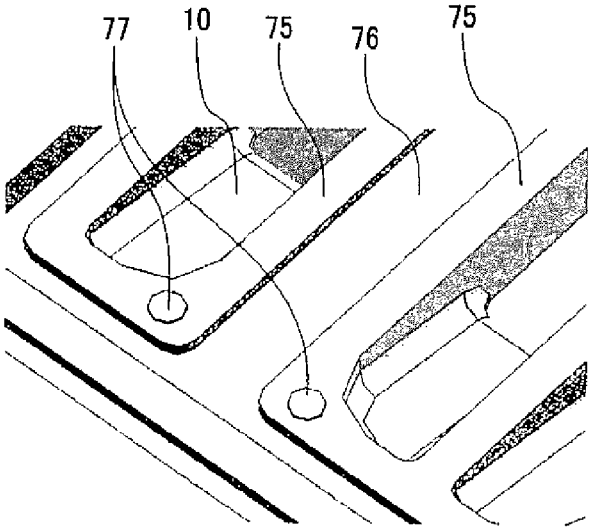
FIG. 12 is an enlarged perspective view of a portion of the frame substrate of FIG. 11.
Figure 13:
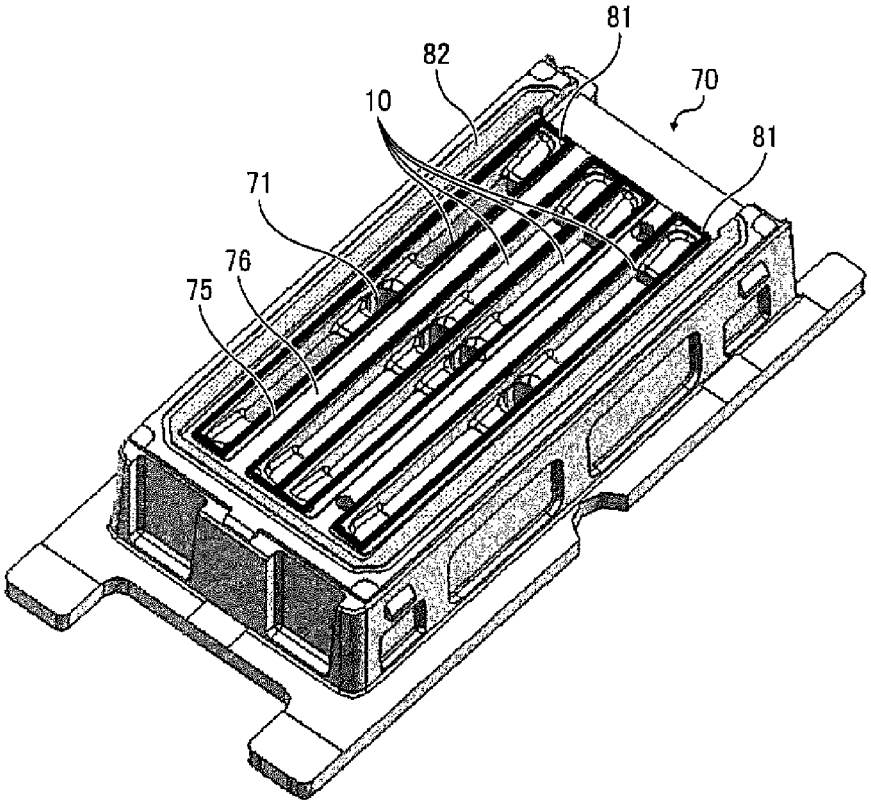
FIG. 13 is a perspective view of the frame substrate of FIG. 11 applied with adhesive.
Figure 14:
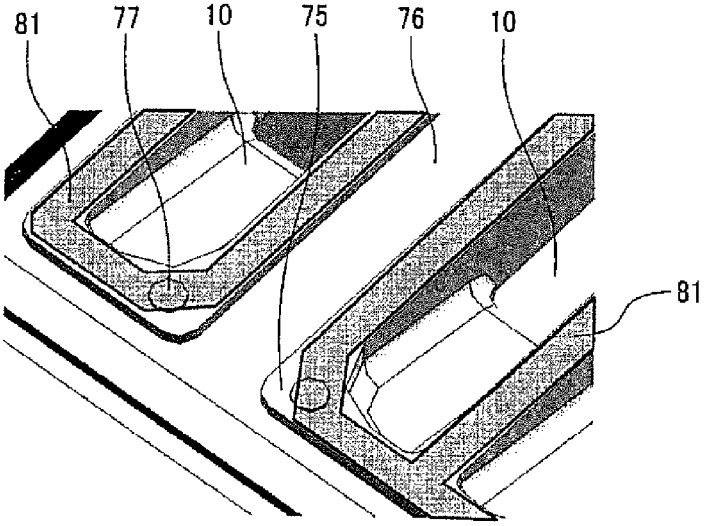
FIG. 14 is an enlarged perspective view of a portion of the frame substrate of FIG. 13.
Figure 15:
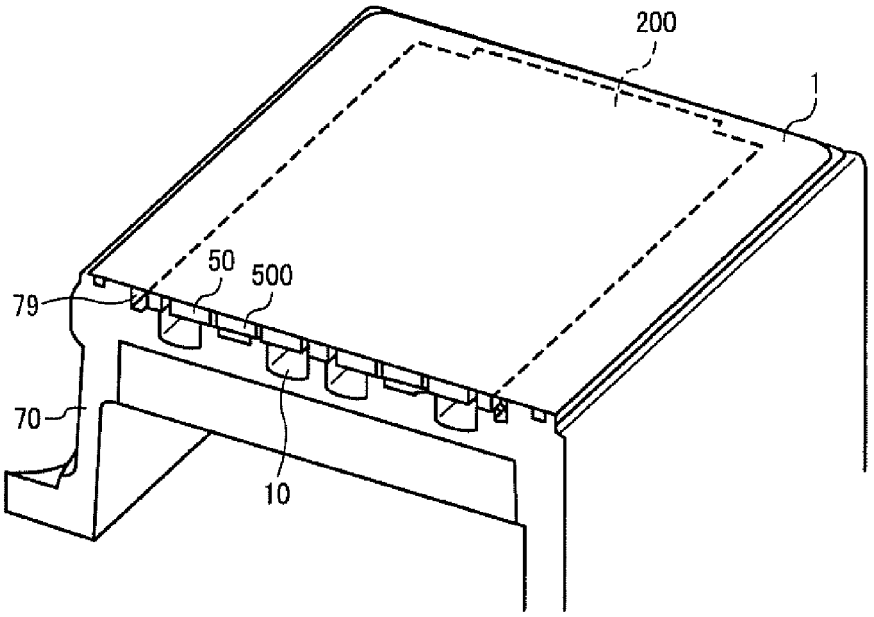
FIG. 15 is a cross-sectional perspective view of the liquid discharge head according to the second embodiment.
Figure 16:
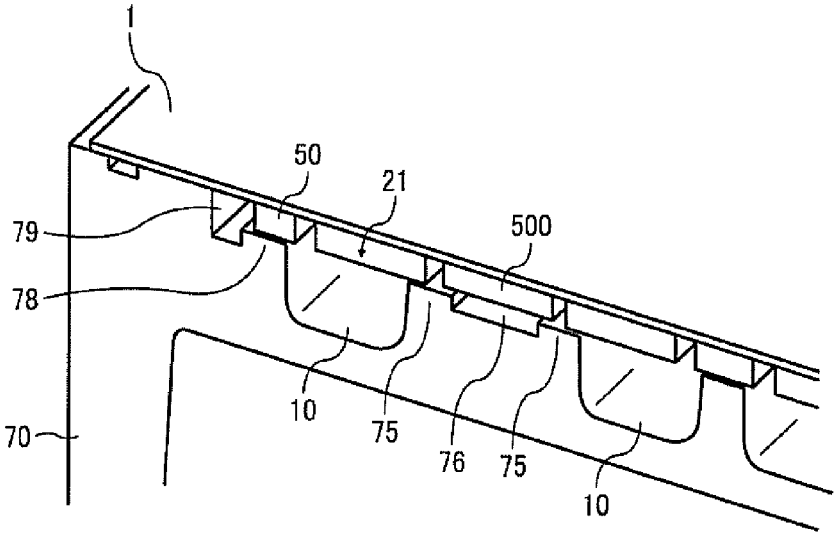
FIG. 16 is an enlarged perspective view of a portion of the liquid discharge head of FIG. 15.
Figure 17:
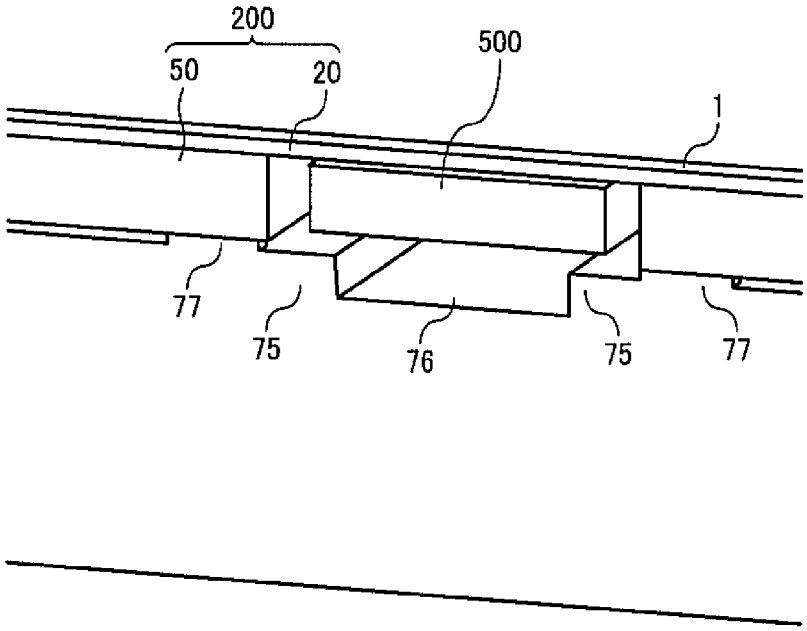
FIG. 17 is a partially-enlarged perspective view of the portion of FIG. 16.

Next, a second embodiment of the present disclosure is described with reference to FIGS. 9 through 17. FIG. 9 is an enlarged cross-sectional view of the liquid discharge head 404 according to the second embodiment cut along the direction perpendicular to the nozzle array direction. FIG. 10 is a plan view of a portion of the holding substrate in the second embodiment. FIG. 11 is a perspective view of the frame substrate in the second embodiment. FIG. 12 is an enlarged perspective view of a portion of the frame substrate of FIG. 11. FIG. 13 is a perspective view of the frame substrate of FIG. 11 applied with adhesive. FIG. 14 is an enlarged perspective view of a portion of the frame substrate of FIG. 13. FIG. 15 is a cross-sectional perspective view of the liquid discharge head according to the second embodiment. FIG. 16 is an enlarged perspective view of a portion of the liquid discharge head of FIG. 15. FIG. 17 is a partially-enlarged perspective view of the portion of FIG. 16.

The frame substrate 70 as the common-liquid-chamber substrate has ribs 75 around the common liquid chambers 10 at a side at which the frame substrate 70 is bonded to the holding substrate 50. A step portion 76 is disposed between adjacent ribs 75 in an area between adjacent common liquid chambers 10.

A plurality of projections 77 is formed on the ribs 75.

In the present embodiment, as described above, the first face (bonded face 50*a*) of the holding substrate 50 opposite the second face of the holding substrate 50 bonded to the actuator substrate 20 constitutes part of the walls of the common liquid chambers 10. Accordingly, the bonded portions of the holding substrate 50 and the frame substrate 70 as the common-liquid-chamber substrate, as illustrated in FIG. 9, include bonded areas 80A and bonded areas 80B. The bonded area 80A proximal to the opening 51 and the bonded area 80B distal to the opening 51 are disposed via the bonded face 50*a*, at which the opening 51 is open to the common liquid chamber 10, in the direction perpendicular to the nozzle array direction NAD.

Hence, as illustrated in FIGS. 10 to 12, the projections 77 are disposed in the bonded areas 80B distal to the openings 51 (see also FIG. 2). In the present embodiment, the projections 77 are disposed at three points of both ends and a central portion of the bonded areas 80B in the nozzle array direction. In some embodiments, the projections 77 may be disposed in the bonded areas 80B of the holding substrate 50.

The frame substrate 70 has a modulus of elasticity lower than a modulus of elasticity of each of the actuator substrate 20 and the holding substrate 50. For example, the frame substrate 70 is made of epoxy resin. In the present embodiment, each of the actuator substrate 20 and the holding substrate 50 is mainly made of silicon substrate and has a modulus of elasticity of about 200 GPa. The frame substrate 70 is made of epoxy resin and has a modulus of elasticity of 10 GPa.

Next, a description is given of operation of the present embodiment.

In the present embodiment as well, the elastic adhesive 81 also serving as the vibration absorber is disposed between the holding substrate 50 and the frame substrate 70 as the common-liquid-chamber substrate. Such a configuration can absorb and decay the vibration transmitted from the holding substrate 50 to the frame substrate 70, thus obtaining stable discharge properties.

In the present embodiment, the projections 77 are disposed on the surfaces of the ribs 75 being the bonded faces of the frame substrate 70. Accordingly, a gap between the bonded faces of the holding substrate 50 and the bonded faces of the frame substrate 70 as the common-liquid-chamber substrate is defined by the projections 77.

For example, when warpage occurs the actuator substrate 20 and the holding substrate 50, the gap between the bonded faces of the holding substrate 50 and the bonded surface with the frame substrate 70 might vary in the longitudinal direction of one of the common liquid chambers 10.

Hence, in the present embodiment, the projections 77 are disposed at both ends and a center portion of the bonded surface of the rib 75 in the nozzle array direction of the common liquid chamber 10. When the frame substrate 70 is pressed against and contacts the holding substrate 50, the projections 77 are pressed against and contact the holding substrate 50 and then the holding substrate 50 and the frame substrate 70 are relatively pressed against each other to correct warpage of the actuator substrate 20 and the holding substrate 50. Such a pressed state is retained, thus maintaining a state in which the projections 77 are pressed against and contact the holding substrate 50.

Accordingly, the gap between the bonded faces of the holding substrate 50 and the bonded surface of the frame substrate 70 is defined by the height of the projections 77, thus reducing the variation in the thickness of the elastic adhesive 81.

In such a case, the height of the projection 77 is preferably not less than 20 μm. In other words, the height of the projection 77 defines the thickness of the elastic adhesive 81 after bonding, and when the thickness of the elastic adhesive 81 is not less than 20 μm, an effective vibration absorbing performance can be obtained.

In bonding of the frame substrate 70 to the holding substrate 50, when the projections 77 of the frame substrate 70 are pressed against and contact the holding substrate 50, the elastic adhesive 81 coated on the frame substrate 70 is likely to extend off.

Hence, in the present embodiment, the projections 77 are disposed at a side of the bonded areas 80B distal to the opening 51 of the holding substrate 50, not a side of the bonded areas 80A proximal to the opening 51.

Such a configuration prevents the elastic adhesive 81 from extending off between the holding substrate 50 and the projections 77 of the frame substrate 70, thus preventing a reduction in the channel area of the opening 51.

In the present embodiment, the material of the frame substrate 70 is described below.

The frame substrate 70 is preferably made of a material having a modulus of elasticity of not greater than 10 GPa. The modulus of elasticity of the frame substrate 70 being not greater than 10 GPa allows absorption of pressure fluctuations in the common liquid chamber 10. However, if the modulus of elasticity of the frame substrate 70 is too low, the intensity and accuracy of the frame substrate 70 might decrease. Accordingly, the modulus of elasticity is preferably not less than 7 GPa.

The frame substrate 70 is preferably made of, for example, epoxy resin. Using epoxy resin can reduce variations in accuracy of the height of the projections 77 and endure pressure without deformation.

For the absorption of vibration transmitted from the holding substrate 50 to the frame substrate 70, the thickness of the vibration absorber (in the present embodiment, adhesive) used is preferably adjusted according to the hardness of the vibration absorber. However, for a resin material that greatly contracts during molding, fine formation of the height and shape is relatively difficult. By contrast, epoxy resin is less likely to contract during molding and fine formation of the height and shape is easier. Epoxy resin containing silica allows the projections 77 to be stably formed at the height of about 20 μm.

Next, the projections and the coated area of adhesive is described with reference to FIGS. 13 and 14.

As illustrated in FIG. 13, the elastic adhesive 81 also acting as the vibration absorber is applied to surround the peripheral area of the common liquid chamber 10 to seal around the common liquid chamber 10. In such a case, as illustrated in FIG. 14, the elastic adhesive 81 is applied to the surfaces of the projections 77.

The projections 77 disposed on the track of application of the elastic adhesive 81 obviate a complex track of application in the application step of the adhesive, which is also reasonable in the number of steps of assembly. If the elastic adhesive 81 is applied while avoiding the projections 77, a space for avoiding the projections 77 would be necessary, thus causing an increase in size of the liquid discharge head.

The elastic adhesive 81 is applied to cover the surfaces of the projections 77. When the structural body 200 is pressed against and contacts the frame substrate 70, a load due to pressure is applied to the elastic adhesive 81. The elastic adhesive 81 coated on the surfaces of the projections 77 are compressed by a pressing force and move around the projections 77. The elastic adhesive 81 on the surfaces of the projections 77 is spread by pressure into a quite thin state, in other words, a state in which the elastic adhesive 81 does not affect the height (thickness) of coating for vibration absorption filled in the gap defined by the projections 77.

In other words, as described above, the projections 77 are disposed at the opposite side of the opening 51. Accordingly, even if the elastic adhesive 81 extends off the surfaces of the projections 77 and the bonded surface of the holding substrate 50, such a configuration can prevent the elastic adhesive 81 from affecting the opening 51, thus allowing the elastic adhesive 81 to be applied to cover the surfaces of the projections 77.

Figure 18:
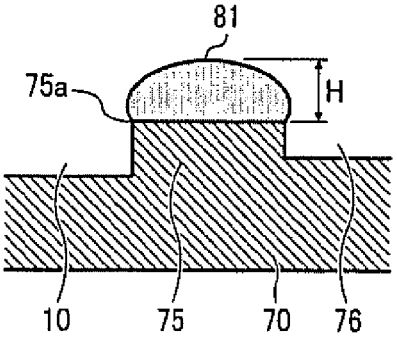
FIG. 18 is a partial enlarged view of a rib portion in the second embodiment.

Next, the shape of the coated surface of the adhesive is described with reference to FIG. 18. FIG. 18 is a partial enlarged view of a rib portion in the second embodiment.

To obtain a vibration absorption effect, a gap space in which the elastic adhesive 81 is regulated by the height of the projections 77 is filled with the elastic adhesive 81, As the height of the projections 77 is higher, the thickness of the elastic adhesive 81 applied is greater (the height H of the elastic adhesive 81 illustrated in FIG. 18 is higher). Hence, as illustrated in FIG. 17, the ribs 75 are disposed surrounding the peripheries of the common liquid chambers 10, and the step portion 76, which is lower than the surface of the rib 75 as a coated surface of the elastic adhesive 81, is disposed between ribs 75 corresponding to adjacent common liquid chambers 10 in the direction perpendicular to the nozzle array direction NAD As illustrated in FIG. 18, by applying the elastic adhesive 81 onto the surface of the rib 75, a surface tension is generated by edge effect at an edge portion 75*a* in a width direction of the rib 75 (the direction perpendicular to the nozzle array direction NAD), thus preventing an outflow of the elastic adhesive 81 to the outside of the width of the rib 75.

As described above, preventing the outflow of the elastic adhesive 81 from the rib 75 can ensure the thickness and height of the elastic adhesive 81 in application.

Such a configuration allows the elastic adhesive 81 to be reliably filled into a space generated when the projections 77 are pressed against and contact the holding substrate 50. Such a configuration also allows the holding substrate 50 and the frame substrate 70 to be reliably bonded to each other without interruption at the periphery of each common liquid chamber 10, thus reliably sealing the periphery of the common liquid chamber 10.

Figure 19:
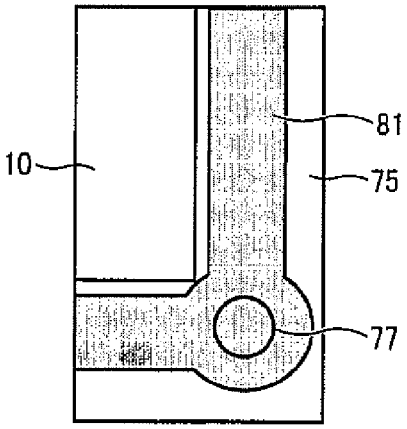
FIG. 19 is a plan view of the projection according in the second embodiment.

Next, the shape of the projection is described with reference to FIG. 19. FIG. 19 is a plan view of the projection according to the second embodiment.

In the present embodiment, the projection 77 has a circular shape, and the elastic adhesive 81 is coated in a shape along the outline of the circular projection 77.

In the present embodiment, as described above, when the projections 77 are pressed against and contact the holding substrate 50, the elastic adhesive 81 coated covering the surfaces of the projections 77 is compressed and pushed out.

In such a case, since the projection 77 is circular, the elastic adhesive 81 pushed out is evenly spread around the projection 77 along the circular outline of the projections 77.

Accordingly, even in the configuration in which the projections 77 are disposed, the gap between the frame substrate 70 and the holding substrate 50 can be reliably sealed around the entire periphery of the common liquid chamber 10.

Next, the bonding of the frame substrate and nozzle plate is described with reference to FIG. 11, FIG. 13, FIG. 15, FIG. 16, and FIG. 17.

As illustrated in FIG. 11, the frame substrate 70 includes ribs 78 as bonded areas to the nozzle plate 1, to surround three directions of each of the common liquid chambers 10. As illustrated in FIG. 13, adhesive 82 is coated on the ribs 78 to bond the frame substrate 70 to the nozzle plate 1.

In other words, as illustrated in FIG. 15, the external size of the nozzle plate 1 is formed greater than the external size of the structural body 200. The frame substrate 70 has the ribs 78 more projecting than the ribs 75 including the projections 77 at a side of the bonded surface of the frame substrate 70 bonded to the holding substrate 50.

The ribs 78 of the frame substrate 70 are bonded to the nozzle plate 1 with the adhesive 82 in areas in which the external size of the ribs 78 are greater than the external size of the structural body 200

When the frame substrate 70 is bonded to the nozzle plate 1 and the holding substrate 50, as illustrated in FIG. 16, a clearance 79 is formed by the outer surfaces of the holding substrate 50 and the actuator substrate 20, the frame substrate 70, and the nozzle plate 1.

Note that the step portion 76 of the frame substrate 70 is disposed opposing the driver IC 500 and, in the present embodiment, disposed above the driver IC 500.

Figure 20:
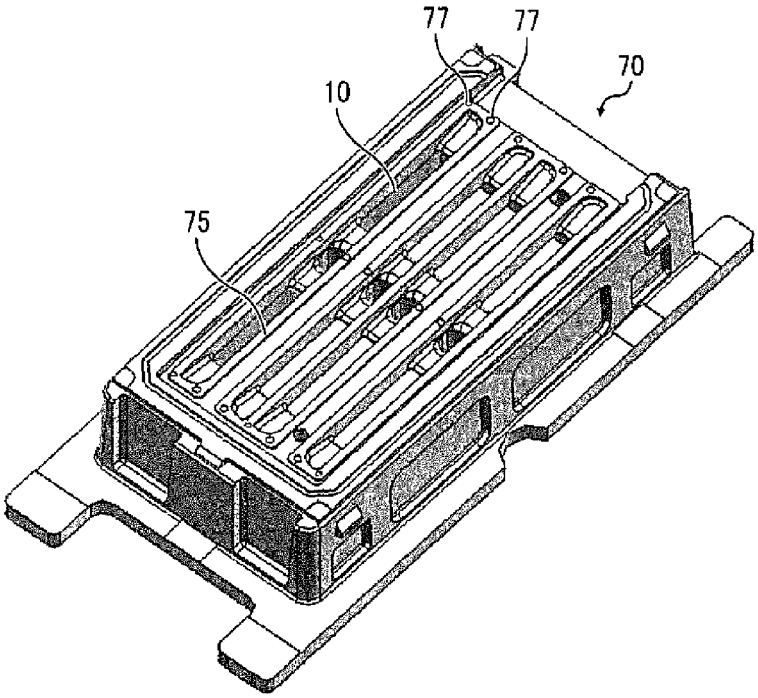
FIG. 20 is a perspective view of the frame substrate according to a third embodiment of the present disclosure.
Figure 21:
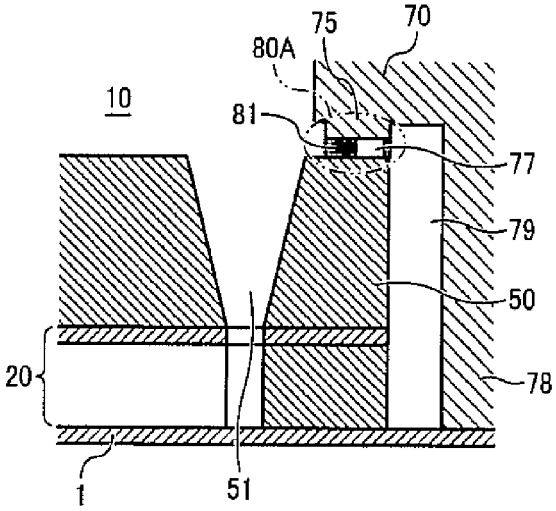
FIG. 21 is a cross-sectional view of a bonded portion of the holding substrate and the frame substrate in the third embodiment.

Next, a third embodiment of the present disclosure is described with reference to FIGS. 20 and 21. FIG. 20 is a perspective view of the frame substrate according to the third embodiment. FIG. 21 is a cross-sectional view of the bonded portion of the holding substrate and the frame substrate in the third embodiment.

For the present embodiment, in the bonded area 80A, the projection 77 is disposed at a position closer to the outer surface of the holding substrate 50 than the opening 51 of the holding substrate 50. Note that the projections 77 are disposed at at least one of the holding substrate 50 and the frame substrate 70.

Such a configuration can prevent the elastic adhesive 81, which might extend off when the projection 77 is pressed against and contact the holding substrate 50, from moving toward the clearance 79 between the frame substrate 70 and the holding substrate 50 and outflowing to the common liquid chamber 10 (the opening 51).

Figure 22:
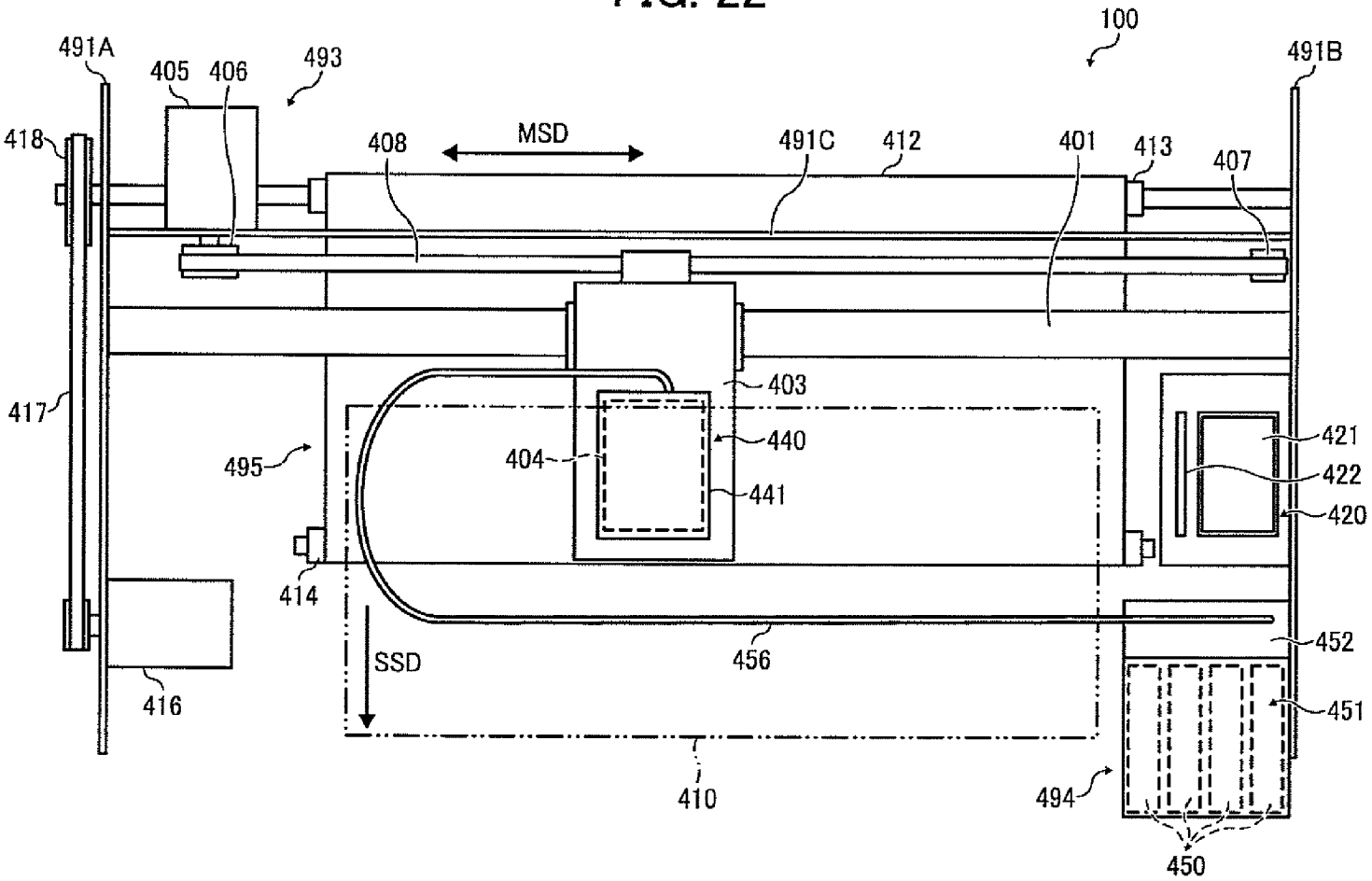
FIG. 22 is a plan view of a portion of a liquid discharge apparatus according to an embodiment of the present disclosure.
Figure 23:
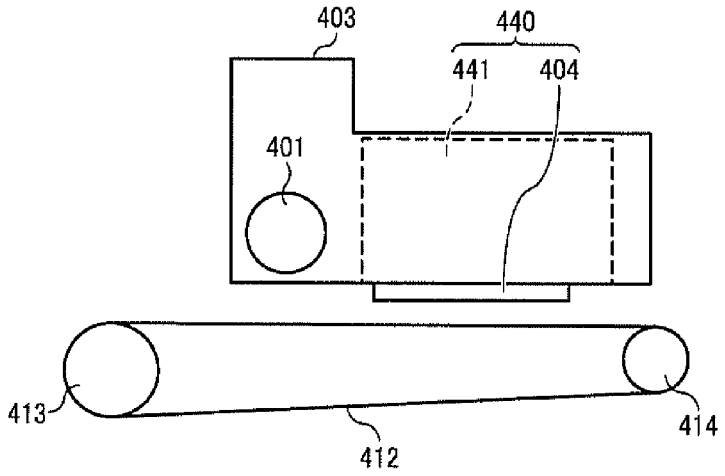
FIG. 23 is a side view of a portion of the liquid discharge apparatus of FIG. 22 including a liquid discharge device.

Next, a liquid discharge apparatus according to an embodiment of the present disclosure is described with reference to FIGS. 22 and 23. FIG. 22 is a plan view of a portion of the liquid discharge apparatus according to an embodiment of the present disclosure. FIG. 23 is a side view of a portion of the liquid discharge apparatus of FIG. 22.

A liquid discharge apparatus 100 according to the present embodiment is a serial-type apparatus in which a main scan moving unit 493 reciprocally moves a carriage 403 in a main scanning direction indicated by arrow MSD in FIG. 22. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 22, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount a liquid cartridge 450, a tube 456, and a liquid feed unit 452 including a liquid feed pump. The liquid cartridge 450 is detachably attached to the cartridge holder 451. The liquid is supplied to the head tank 441 by the liquid feed unit 452 via the tube 456 from the liquid cartridge 450.

The liquid discharge apparatus 100 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, a sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 100 includes the liquid discharge head 404 according to an embodiment of the present disclosure, thus allowing stable formation of high quality images.

Figure 24:
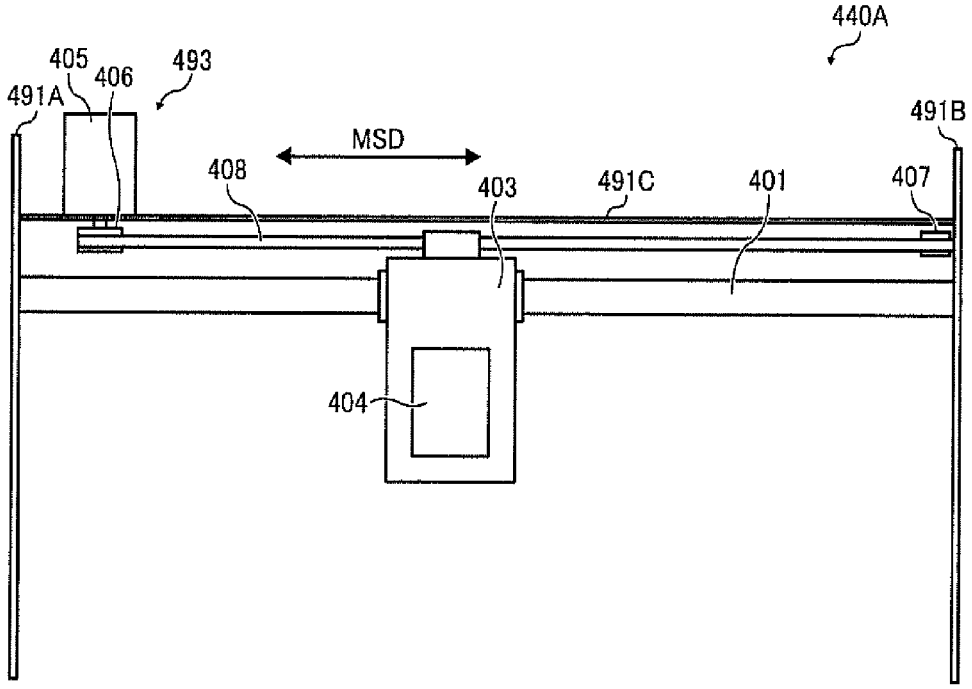
FIG. 24 is a plan view of a portion of another example of the liquid discharge device.

Next, another example of the liquid discharge device according to an embodiment of the present disclosure is described with reference to FIG. 24. FIG. 24 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 100. The left side plate 491A, the right side plate 491B, and the rear side plate 491C form the housing.

Note that, in the liquid discharge device 440A, at least one of the maintenance unit 420 and the supply unit 494 may be mounted on, for example, the right side plate 491B.

Figure 25:
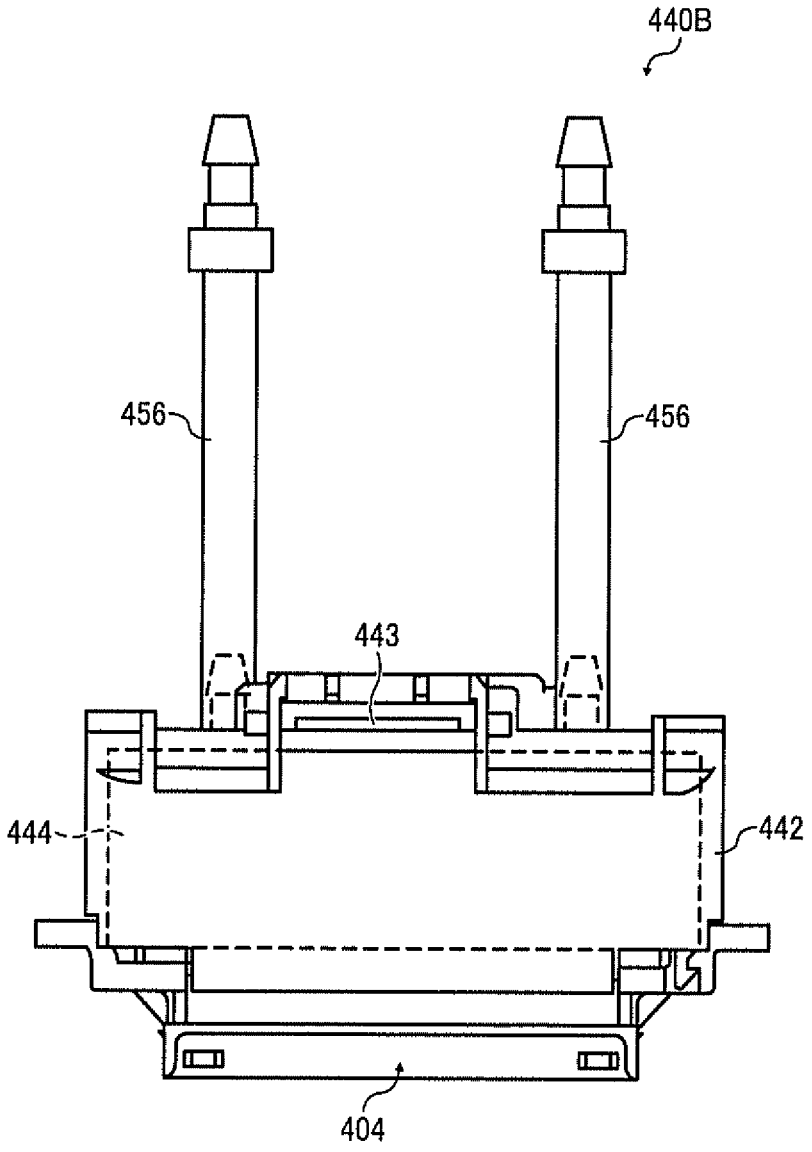
FIG. 25 is a front view of still another example of the liquid discharge device.

Next, still another example of the liquid discharge device according to an embodiment of the present disclosure is described with reference to FIG. 25. FIG. 25 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere or an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to discharge liquid to form an image on a medium or a solid fabricating apparatus (three-dimensional fabricating apparatus) to discharge a fabrication liquid to a powder layer in which powder is formed in layers to form a solid fabricating object (three-dimensional object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described material to which liquid can adhere may include any material to which liquid may adhere even temporarily. The material to which liquid can adhere may be, e.g., paper, thread, fiber, fabric, leather, metal, plastics, glass, wood, or ceramics, to which liquid can adhere even temporarily.

The liquid may be, e.g., ink, treatment liquid, DNA sample, resist, pattern material, binder, or mold liquid.

The liquid discharge apparatus may be, unless in particular limited, any of a serial-type apparatus to move the liquid discharge head and a line-type apparatus not to move the liquid discharge head.

The liquid discharge apparatus may be, e.g., a treatment liquid coating apparatus to discharge a treatment liquid to a sheet to coat the treatment liquid on the surface of the sheet to reform the sheet surface or an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may also be a combination in which the liquid discharge head and a functional part(s) are secured to each other through, e.g., fastening, bonding, or engaging, or a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 23. The liquid discharge head and the head tank may be connected each other via, e.g., a tube to integrally form the liquid discharge device. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by a guide that forms part of a main-scanning moving device, so that the liquid discharge head and the main-scanning moving device are integrated as a single unit. Like the liquid discharge device 440A illustrated in FIG. 24, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 25, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of individual liquid chambers communicated with a plurality of nozzles to discharge liquid;

a plurality of pressure generating elements arrayed to pressurize liquid in the plurality of individual liquid chambers;

a holding substrate including a recessed portion to accommodate the plurality of pressure generating elements;

a common-liquid-chamber substrate including a common liquid chamber to supply the liquid to the plurality of individual liquid chambers, the common-liquid-chamber substrate bonded to the holding substrate;

a vibration absorber disposed at least a part of a bonded portion of the common-liquid-chamber substrate and the holding substrate, to absorb vibration; and a projection on a bonded face of at least one of the common-liquid-chamber substrate and the holding substrate, wherein the projection is not lower than 20 μm in height.

2. The liquid discharge head according to claim 1, wherein the vibration absorber is an elastic adhesive to bond the common-liquid-chamber substrate to the holding substrate.

3. The liquid discharge head according to claim 2, wherein the elastic adhesive has a modulus of elasticity of not greater than 10 MPa.

4. The liquid discharge head according to claim 1, wherein the holding substrate is configured to have an opening as a channel communicating the plurality of individual liquid chambers with the common liquid chamber, wherein a face of the holding substrate, in which the opening is open to the common liquid chamber, constitutes part of a wall of the common liquid chamber, wherein the bonded portion of the common-liquid-chamber substrate and the holding substrate includes a first bonded area proximal to the opening and a second bonded area distal to the opening in a direction perpendicular to a nozzle array direction in which the plurality of nozzles is arrayed in row, and wherein the projection is disposed at the second bonded area distal to the opening.

5. The liquid discharge head according to claim 1, wherein the holding substrate is configured to have an opening as a channel communicating the plurality of individual liquid chambers with the common liquid chamber, wherein the projection is disposed at a position closer to an outer peripheral surface of the holding substrate than the opening of the holding substrate.

6. The liquid discharge head according to claim 1, further comprising:

an actuator substrate including the plurality of individual liquid chambers and the plurality of pressure generating elements, wherein a modulus of elasticity of the common-liquid-chamber substrate is lower than a modulus of elasticity of the actuator substrate.

7. The liquid discharge head according to claim 6, wherein the modulus of elasticity of the common-liquid-chamber substrate is not greater than 10 GPa.

8. The liquid discharge head according to claim 7, wherein the common-liquid-chamber substrate is made of epoxy resin.

9. A liquid discharge device comprising the liquid discharge head according to claim 1.

10. The liquid discharge device according to claim 9, wherein the liquid discharge head is integrated as a single unit with at least one of:

a head tank to store the liquid to be supplied to the liquid discharge head;

a carriage mounting the liquid discharge head;

a supply unit to supply the liquid to the liquid discharge head;

a maintenance unit to maintain and recover the liquid discharge head; and a main scan moving unit to move the liquid discharge head in a main scanning direction.

11. A liquid discharge apparatus comprising the liquid discharge device according to claim 9 to discharge the liquid.

12. A liquid discharge apparatus comprising the liquid discharge head according to claim 1 to discharge the liquid.

13. A liquid discharge head comprising:

a plurality of individual liquid chambers communicated with a plurality of nozzles to discharge liquid;

a plurality of pressure generating elements arrayed to pressurize liquid in the plurality of individual liquid chambers;

a holding substrate including a recessed portion to accommodate the plurality of pressure generating elements;

a common-liquid-chamber substrate including a common liquid chamber to supply the liquid to the plurality of individual liquid chambers, the common-liquid-chamber substrate bonded to the holding substrate;

a vibration absorber disposed at least a part of a bonded portion of the common-liquid-chamber substrate and the holding substrate, to absorb vibration; and a projection on a bonded face of at least one of the common-liquid-chamber substrate and the holding substrate, wherein the projection is circular.

14. A liquid discharge apparatus comprising the liquid discharge head according to claim 13, to discharge the liquid.

15. A liquid discharge head comprising:

a plurality of individual liquid chambers communicated with a plurality of nozzles to discharge liquid;

a plurality of pressure generating elements arrayed to pressurize liquid in the plurality of individual liquid chambers;

a holding substrate including a recessed portion to accommodate the plurality of pressure generating elements;

a common-liquid-chamber substrate including a common liquid chamber to supply the liquid to the plurality of individual liquid chambers, the common-liquid-chamber substrate bonded to the holding substrate;

a vibration absorber disposed at least a part of a bonded portion of the common-liquid-chamber substrate and the holding substrate, to absorb vibration;

a rib surrounding the common liquid chamber and disposed on a bonded face of at least one of the common-liquid-chamber substrate and the holding substrate; and a projection disposed on the bounded face.

16. A liquid discharge apparatus comprising the liquid discharge head according to claim 15, to discharge the liquid.

* * * * *